US007511726B2

(12) United States Patent
Kim et al.

(10) Patent No.: US 7,511,726 B2
(45) Date of Patent: Mar. 31, 2009

(54) DISPLAY AND CONTROL METHOD THEREOF

(75) Inventors: Young-chan Kim, Euiwang-si (KR); Yong hyun Kim, Seongnam-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 926 days.

(21) Appl. No.: 10/973,265

(22) Filed: Oct. 27, 2004

(65) Prior Publication Data

US 2005/0099437 A1 May 12, 2005

(30) Foreign Application Priority Data

Nov. 6, 2003 (KR) ..... 10-2003-0078229

(51) Int. Cl.
*G09G 3/36* (2006.01)
*G09G 5/02* (2006.01)

(52) U.S. Cl. ..... 345/699; 345/3.4

(58) Field of Classification Search ..... 345/87–100, 345/204–214, 699
See application file for complete search history.

(56) References Cited

U.S. PATENT DOCUMENTS

| | | | | |
|---|---|---|---|---|
| 6,078,317 | A * | 6/2000 | Sawada | 345/204 |
| 6,809,716 | B1 * | 10/2004 | Kim | 345/98 |
| 7,317,451 | B2 * | 1/2008 | Kim | 345/204 |
| 2003/0011588 | A1 | 1/2003 | Kim | |

FOREIGN PATENT DOCUMENTS

| | | |
|---|---|---|
| JP | 8-314408 | 11/1996 |
| JP | 11-261411 | 9/1999 |
| JP | 2000-155553 | 6/2000 |
| JP | 2001-42844 | 2/2001 |
| KR | 10-212849 | 5/1999 |
| KR | 10-231305 | 8/1999 |
| KR | 10-251967 | 1/2000 |
| KR | 10-258531 | 3/2000 |
| KR | 2001-94496 | 11/2001 |
| KR | 10-385995 | 1/2003 |

OTHER PUBLICATIONS

International Search Report for International Application No. PCT/KR2004/002855, dated Feb. 21, 2005.

Reference AF: Korean Publication No. 10-258531, published Mar. 13, 2000 is generally related to "Display and Control Method Thereof".

(Continued)

*Primary Examiner*—David L Lewis
(74) *Attorney, Agent, or Firm*—Staas & Halsey LLP

(57) ABSTRACT

The present invention relates to an apparatus and a method of determining a display mode from a plurality of display modes for a display device that displays an image, each display mode relates to an inputted signal from a signal source that includes an analog signal and an H/V synchronization signal, the method including determining at least one display mode corresponding to the inputted H/V synchronization signal; converting the inputted analog signal to a digital signal according to a sampling signal corresponding to each of the at least one determined display mode; and displaying the image using a display mode from the at least one determined display mode that most closely relates to the signal source.

17 Claims, 5 Drawing Sheets

OTHER PUBLICATIONS

Reference AG: Korean Publication No. 10-231305, published Aug. 27, 1999 is generally related to "Display and Control Method Thereof".

Reference AH: Korean Publication No. 10-212849, published May 12, 1999 is generally related to "Display and Control Method Thereof".

Reference AI: Korean Publication No. 10-251967, published Jan. 14, 2000 is generally related to "Display and Control Method Thereof".

Reference AJ: Korean Publication No. 2001-94496, published Nov. 1, 2001 is generally related to "Display and Control Method Thereof".

* cited by examiner

DISPLAY AND CONTROL METHOD THEREOF

CROSS-REFERENCE TO RELATED APPLICATION

This application claims the benefit of Korean Patent Application No. 2003-078229, filed on Nov. 6, 2003, in the Korean Intellectual Property Office, the disclosure of which is incorporated herein by reference.

BACKGROUND OF THE INVENTION

1. Field of the Invention

The present invention relates to a display and control method thereof, and more particularly, to a display to display an image of inputted video signal from a video signal source, according to the most suitable display mode and a control method thereof.

2. Description of the Related Art

A display apparatus generally displays a video signal having a predetermined display mode inputted from a video signal source such a computer, a TV broadcasting system, or the like. The display apparatus may be either a CRT display or a flat-panel display, such as an LCD.

The flat-panel display generally uses a digital mode wherein an analog video signal inputted from a video signal source is converted into a digital video signal and an image is displayed on the basis of the converted digital video signal. A display apparatus in which a digital video signal is directly inputted from a video signal source and processed has recently been developed.

The video signal inputted from the video signal source, such as the computer or the TV broadcasting system, has a variety of display modes. For example, a computer graphic card supports a variety of display modes, such as video graphics array (VGA), extended graphics array (XGA), super video graphics array (SVGA), ultra super video graphic array (USVGA) and the like. Displays are now being used as both a computer monitor and as a TV monitor, which may support a variety of display modes for a TV signal. Thus, the display apparatus supports a variety of resolutions, such as 640×480 60 Hz, 640×480 75 Hz, 800×600 60 Hz, 1024×768 60 Hz, 1600×1200 60 Hz and 1920×1200 60 Hz. The display apparatus determines the display mode on the basis of an H/V synchronization signal inputted from a video signal source and converts an analog video signal into a digital signal according to a sampling signal corresponding to the determined display mode.

However, the conventional display apparatus may not cover the variety of display modes described above. If the display mode has the same frequency of the H/V synchronization signal but a different resolution, the conventional display apparatus cannot recognize the difference and displays an image according to a display mode that is different from the inputted video signal and that the image does not correspond to the inputted video signal.

SUMMARY OF THE INVENTION

Accordingly, an aspect of the invention is to provide a method of determining a display mode from a plurality of display modes for a display device that displays an image, each display mode relates to an inputted signal from a signal source that includes an analog signal and an H/V synchronization signal, the method including determining at least one display mode corresponding to the inputted H/V synchronization signal; converting the inputted analog signal to a digital signal according to a sampling signal corresponding to each of the at least one determined display mode; and displaying the image using a display mode from the at least one determined display mode that most closely relates to the signal source.

According to an aspect of the invention, the displaying the image using the display mode that most closely relates to the signal source further includes detecting a property of each converted digital signal; and selecting the display mode having the detected property that most closely relates to the signal source from among the at least one determined display modes.

According to an aspect of the invention, the detected property is a horizontal and vertical frequency of the H/V synchronization signal.

According to an aspect of the invention, the analog signal is sampled with a predetermined frequency corresponding to the at least one determined display mode.

According to another aspect of the invention, the at least one display mode corresponding to the inputted H/V synchronization signal that relates to a resolution and a timing mode of the inputted signal is determined.

According to another aspect of the invention, the determined at least one display mode includes a plurality of similar display modes, such that each of the similar display modes has a different sampling signal, wherein each of the similar display modes has a same horizontal and vertical frequency but a different resolution from one another.

According to another aspect of the invention, the method of determining the display mode includes detecting a property of the converted digital signal according to each sampling signal; and selecting a display mode having the detected property that is most closely related to the inputted signal from among the plurality of similar display modes.

According to another aspect of the invention, the method of determining the display mode includes controlling the sampling signal and scaling the converted digital signal to display the image according to a display mode that is most closely related to the inputted signal, wherein the detecting the property of the converted digital signal includes calculating a difference between adjacent sampling values of each of the digital signals; integrating an absolute value of the calculated difference between the adjacent sampling values, and selecting the display mode having the greatest integration value of the absolute value of the difference between the adjacent sampling values.

According to another aspect of the invention, the method of determining the display mode includes temporarily storing frames of each of the converted digital signals, wherein the detecting the signal property of each of the digital signals includes reading out data on at least one same V-line of each of adjacent frames of each of the digital signals from the frame buffer; detecting a difference between the read data for the adjacent frames of each of the digital signals; and selecting the display mode having a smallest difference relating to the read data.]

According to another aspect of the invention, the method of detecting the signal property of the converted digital signal includes determining when a sampling value of each of the digital signals is within a predetermined range; and counting each sampling value of each of the digital signals that is within the predetermined range, and selecting the display mode having a fewest number of counted sampling values.

According to another aspect of the invention, the method of detecting the signal property of the digital signal converted according to each of the sampling signals includes determining when a sampling value of each of the digital signals is within a predetermined range; counting each sampling value of each of the digital signals that is not within the predetermined range; and selecting the display mode having a greatest number of counted sampling values.

According to another aspect of the invention, there is provided a display device to display an inputted signal relating to one of a plurality of determined similar display modes corresponding to an inputted signal from a signal source, including a signal property detector to detect a signal property of the inputted signal that is converted according to a sampling signal; and a controller to determine a display mode that most closely relates to the inputted signal from the plurality of determined similar display modes, wherein the controller detects each display mode from among the plurality of similar display modes and outputs a sampling signal corresponding to each of the display modes, respectively, and further controls the signal property detector to detect the signal property of each of the plurality of converted signals.

According to another aspect of the invention, the display device includes a sampling signal unit to output the sampling signal corresponding to each of the plurality of determined display modes in order to sample the converted inputted signal; and a digital converter to convert the inputted signal to a digital signal according to each of the sampling signals output by the sampling signal unit.

According to another aspect of the invention, the signal property detector integrates an absolute value of a difference between adjacent sampling values of each of the converted signals corresponding to each of the sampling signals, and the controller controls to display an image according to a display mode having a greatest integration value of an absolute value of a difference between the sampling values.

According to another aspect of the invention, the signal property detector counts sampling values within a predetermined range from among sampling values of each of the converted signals corresponding to each of the sampling signals, and the controller controls to display an image according to a display mode having a fewest number of counted sampling values.

According to another aspect of the invention, the signal property detector counts sampling values that are not within a predetermined range from among sampling values of each of the converted signals corresponding to each of the sampling signals, and the controller controlling to display an image according to a display mode having a most number of counted sampling values.

According to another aspect of the invention, the controller controls the signal property detector to detect the signal property of the converted signal according to the sampling signal after an auto adjustment function is performed for each of the similar display modes.

BRIEF DESCRIPTION OF THE DRAWINGS

These and/or other aspects and advantages of the invention will become apparent and more readily appreciated from the following description of the embodiments taken in conjunction with the accompanying drawings in which.

DETAILED DESCRIPTION OF THE PREFERRED EMBODIMENTS

Figure 1:
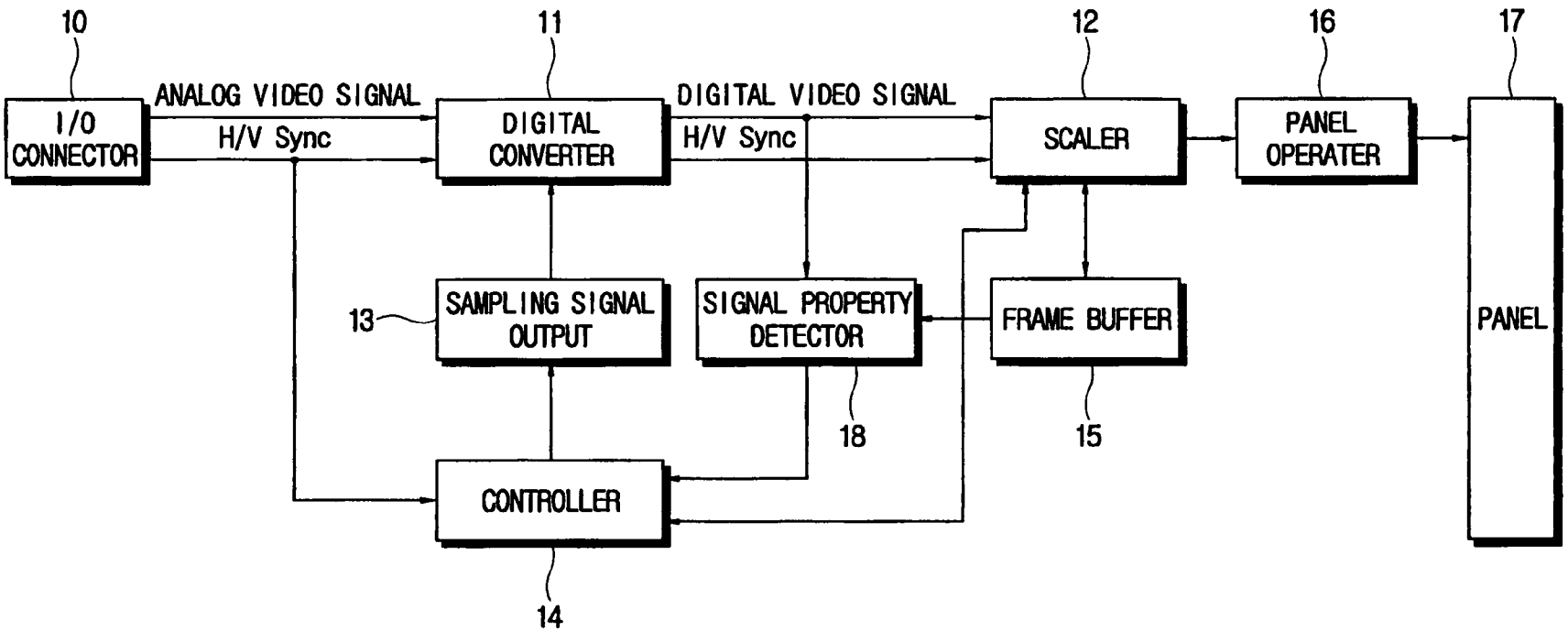
FIG. 1 is a control block diagram of a display according to an embodiment of the invention.

Reference will now be made in detail to the embodiments of the present invention, examples of which are illustrated in the accompanying drawings, wherein like reference numerals refer to like elements throughout. The embodiments are described below in order to explain the present invention by referring to the figures.

As shown in FIG. 1, a display according to an aspect of the invention includes an input/output (I/O) connector 10, a sampling signal output 13 to output a sampling signal sampling an analog video signal inputted from the I/O connector 10, a digital converter 11 converting the analog video signal into a digital video signal on the basis of the sampling signal from the sampling signal output 13, a frame buffer 15 temporarily storing the digital video signal from the digital converter 11 by frame unit, a scaler 12 scaling the digital video signal from the digital converter 11, and a controller 14 controlling the I/O connector 10, the sampling signal output 13, the digital converter 11, the frame buffer 15 and the scaler 12. The display according to the embodiment of the present invention further includes a panel 17 to display an image and a panel operator 16 to process a video signal from the scaler 12 to display the image on the panel 17.

The I/O connector 10 inputs an analog video signal and an H/V synchronization signal from a video signal source, such as a computer, a TV broadcasting system, and the like. The I/O connector 10 may include a variety of connectors to input a variety of formats of video signal. For example, the I/O connector 10 to input an analog video signal may include of at least one of a D-sub connector, a composite video broadcast signal (CVBS) signal connector, an S-video connector and a component connector.

The sampling signal output 13 outputs a sampling signal within a predetermined frequency to sample the analog video signal inputted through the I/O connector 10. For example, the sampling signal output 13 outputs a sampling signal corresponding to a display mode determined by the controller 14.

The controller 14 determines the display mode on the basis of the H/V synchronization signal inputted through the I/O connector 10. Here, the controller 14 determines the display mode that relates to a resolution and a timing mode of the inputted video signal on the basis of a frequency of the H/V synchronization signal. The controller 14 controls the sampling signal output 13 to output a sampling signal corresponding to the determined display mode.

The display apparatus further includes a signal property detector 18 to detect properties of the digital video signal from the digital converter 11. When the controller 14 determines on the basis of the H/V synchronization signal that there are a plurality of similar display modes, the controller 14 controls the sampling signal output 13 to output sampling signals that are different from one another and corresponding to each of the plurality of similar display modes. For example, the similar display modes may be understood as display modes that have the same horizontal and vertical frequencies but different resolutions from one another, when the controller 14 determines the display mode on the basis of the horizontal and vertical frequencies of the H/V synchronization signal, or vice-versa. Further, when the controller 14 determines the display mode on the basis of another property of the H/V synchronization signal property, the similar display modes may be understood as display modes that have the same property determined by the controller 14 but also have undetermined properties that are different from one another.

The controller 14 controls the signal property detector 18 to detect a signal property of the digital video signal converted by the digital converter 11, according to each of the sampling signals. The controller 14 compares the signal property of the digital video signal, each property corresponding to each of the sampling signals for each of the display modes and determines the display mode having the most suitable signal property. Further, the controller 14 controls the sampling signal output 13 and the scaler 12 to display an image according to the display mode having the most suitable signal property.

Hereinbelow is a description of a control method of the display according to the aspect of the invention.

If an analog video signal and an H/V synchronization signal are input by a video signal source through the I/O connector 10 at operation 10, the controller 14 determines a display mode on the basis of the inputted H/V synchronization signal at operation 11. The controller 11 examines whether there are a plurality of similar display modes at operation 12. When only one display mode is examined, the controller 14 controls to display an image according to the corresponding display mode at operation 21.

When the controller 14 determines that there are a plurality of similar display modes, the controller 14 controls the sampling signal output 13 to output a sampling signal (referred to as "a first sampling signal") corresponding to one of the plurality of similar display modes (]referred to as "a first display mode) at operation 13. The digital converter 11 converts the analog video signal into the digital video signal (referred to as "a first digital video signal"), on the basis of the first sampling signal at operation 14. The controller 14 controls the signal property detector 18 to detect a signal property of the first digital video signal at operation 16.

In order to detect a signal property of the other display modes among the plurality of similar display modes examined at operation 12, the controller 14 examines again whether there is a display mode whose signal property has not been detected at operation 17. When there is a display mode whose signal property has not been detected at operation S20, the controller 14 controls the sampling signal output 13 to output a sampling signal (referred to as "a second sampling signal") corresponding to the display mode (referred to as a second display mode) examined at operation 17. For example, the digital converter 11 converts the analog video signal into the digital video signal (referred to as "a second digital video signal"), on the basis of the second sampling signal at operation S14. The controller 14 controls the signal property detector 18 to detect a signal property of the second digital video signal at operation 16.

The controller 14 examines repeatedly whether there is a display mode whose signal property has not been detected among the display modes detected at operation 12. When there is a display mode whose signal property have not been detected, the operations 20, 14, and 16 are sequentially accomplished, such that the signal properties of the remaining display modes among the plurality of similar display modes examined at operation 12 are sequentially detected.

The controller 14 compares the first digital video signal with the second digital video signal, each detected by the signal property detector 18, and determines the display mode having the most suitable signal property at operation 19. The controller 14 controls the sampling signal output 13, the digital converter 11 and the scaler 12 to display an image according to the display mode having the most suitable signal property, thereby displaying an image according to the most suitable display mode at operation 20.

Hereinbelow, operations of the signal property detector 18 and a method of determining the display mode having the most suitable signal property by the controller 14 are described, according to various aspects of the invention. The display modes determined by the controller 14 are assumed to include the first and second display modes and the first display mode is suitable for the inputted video signal.

Figure 3A:
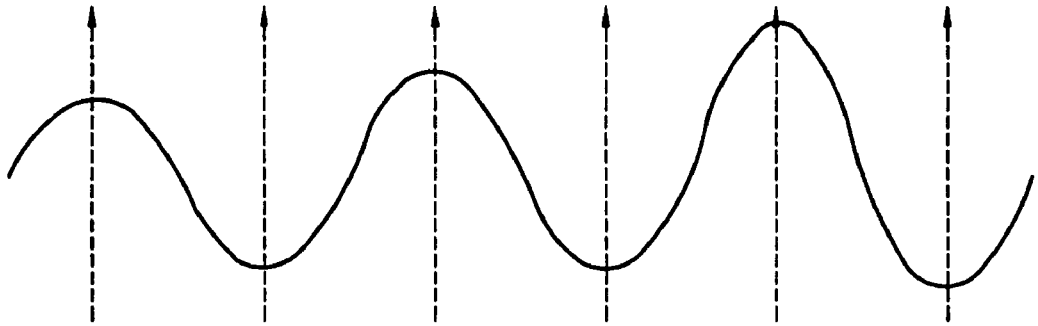
FIG. 3A illustrates an analog video signal sampled by a first sampling signal.
Figure 3B:
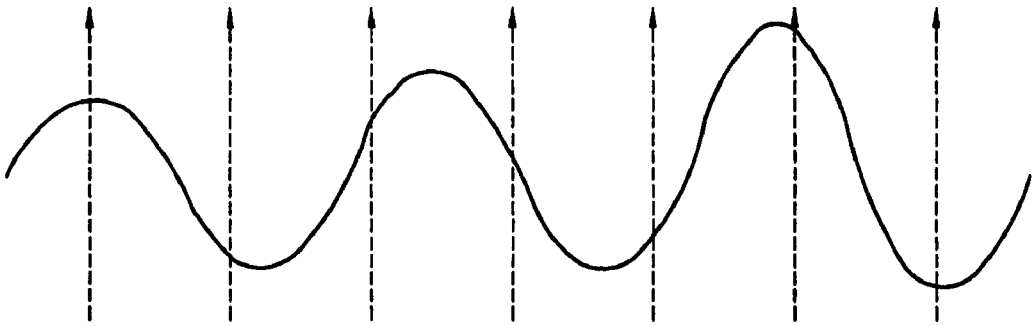
FIG. 3B illustrates an analog video signal sampled by a second sampling signal.

According to an aspect of the invention as shown in FIGS. 3A and 3B, the signal property detector 18 integrates an absolute value of a difference between the adjacent sampling values of the first digital video signal and the second video signal, each converted by the first sampling signal and the second sampling signal, respectively. Thus, as shown in FIG. 3A, when the analog video signal is sampled according to the first sampling signal suitable for the inputted video signal, an H-total value according to the first sampling signal is suitable for the inputted video signal, and the sampling is accomplished at peaks of the analog video signal. However, as shown in FIG. 3B, when the analog video signal is sampled according to the second sampling signal corresponding to the second display mode, an H-total value according to the second sampling signal is not suitable for the inputted video signal, and the sampling is not accomplished at the peaks of the analog video signal. The difference between the adjacent sampling values is greater when the sampling positions are the peaks of the analog video signal. Consequently, when the absolute value of difference between the adjacent sampling values is integrated, the value integrated according to the first digital video signal converted by the first sampling signal is greater than the value integrated according to the second digital video signal converted by the second sampling signal. Accordingly, the controller 14 recognizes the first display mode as a display mode having the most suitable signal property, because the first display mode has a greater value integrated by the signal property detector 18. Thus, the controller 14 controls to display an image according to the first display mode.

Figure 4:
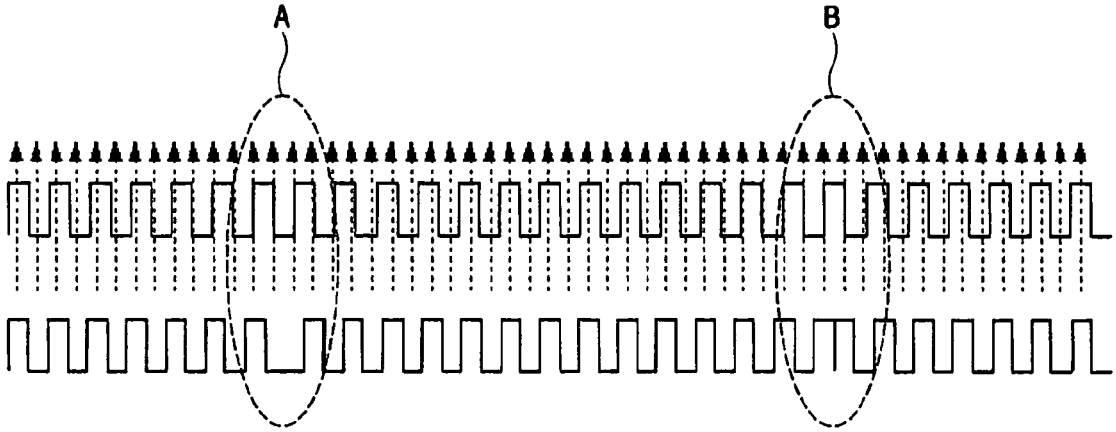
FIG. 4 illustrates frames or changed data of the analog video signal sampled by the second sampling signal.

The signal property detector 18 according to another aspect of the invention, as shown in FIG. 4, reads out data on at least one same V-line of each of adjacent frames of the first digital video signal corresponding to the first sampling signal and data on at least one same V-line of each of adjacent frames of the second digital video signal corresponding to the second sampling signal, wherein the data is stored in the frame buffer 15. The signal property detector 18 reads out, for example, data on the same V-line of each of the adjacent two frames from among data of the adjacent two frames of the first digital video signal sampled by the first sampling signal corresponding to the first display mode. Then, the signal property detector 18 reads out, for example, data on the same V-line of each of adjacent two frames, among data of the adjacent two frames of the second digital video signal sampled by the second sampling signal corresponding to the second display mode. Data corresponding to the first and second display modes are preferably read out on the same V-line.

The controller 14 detects a data difference between the adjacent frames of the first display mode and detects a data difference between the adjacent frames of the second display mode. The controller 14 compares the data difference between the adjacent frames of the first display mode to the data difference between the adjacent frames of the second display mode. The controller 14 recognizes the display mode having a smaller data difference as the display mode having the most suitable signal property and controls to display an image according to the corresponding display mode.

The value of data of the adjacent frames of the first digital video signal sampled by the first sampling signal corresponding to the first display mode is generally uniform. However, data of adjacent frames of the second digital video signal sampled by the second sampling signal corresponding to the second display mode are different in the H-total value according to the second sampling signal. Thus, for the second display mode, when a wrong sampling signal is input, sampling is accomplished at edges of the analog video signal, such that the sampling value of a predetermined position of the frame buffer 15 has a repeatedly small difference at each frame. Accordingly, the signal property detector 18 reads out the data from the frame buffer 15 and the controller 14 analyzes the data to determine the display mode having a smaller data difference as the display mode having the most suitable signal property. FIG. 4 shows parts A and B in which data sampled by the second sampling signal are changed when images are displayed according to the second display mode.

Figure 5A:
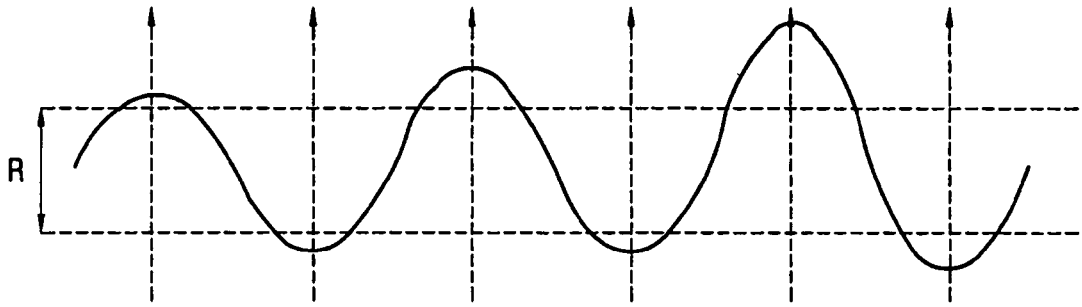
FIG. 5A shows an analog video signal sampled by the first sampling signal with regard to a standard range.
Figure 5B:
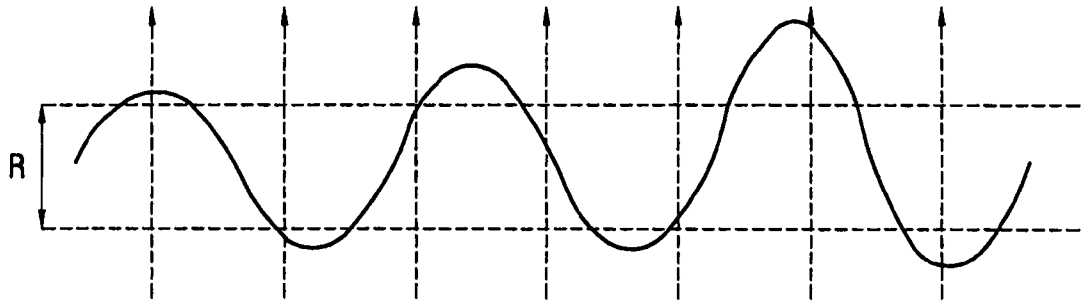
FIG. 5B shows an analog video signal sampled by the second sampling signal with regard to the standard range.

A signal property detector 18 according to another aspect of the invention, as shown in FIGS. 5A and 5B, counts sampling values within the predetermined range from among sampling values of the first digital video signal and the second digital video signal converted by the first sampling signal and the second sampling signal, respectively. The controller 14 recognizes the display mode having a lowest counting number between the counting numbers each corresponding to the first digital video signal and the second digital video signal detected by the signal property detector 18 as the display mode having the most suitable signal property. The controller 14 controls to display an image according to the corresponding display mode. As shown FIGS. 5A and 5B, when the analog video signal is sampled according to the first sampling signal corresponding to the first display mode, an H-total value according to the first sampling signal is suitable for the inputted video signal, so that sampling is accomplished at peaks of the video signal. The more suitable the display mode is, the fewer the number of samplings that are located within the standard value R. Thus, the controller 14 determines the display mode having a fewer counting value between the counting numbers detected by the signal property detector 18 as the display mode having the most suitable signal property.

A signal property detector 18 according to another aspect of the invention counts sampling values not within the predetermined ranges from among sampling values of the first digital video signal and the second digital video signal each converted by the first sampling signal and the second sampling signal. The controller 14 recognizes the display mode having a greatest counting number between the counting numbers each corresponding to the first digital video signal and the second digital video signal detected by the signal property detector 18 as the display mode having the most suitable signal property. The controller 14 controls to display an image according to the corresponding display mode.

Figure 2:
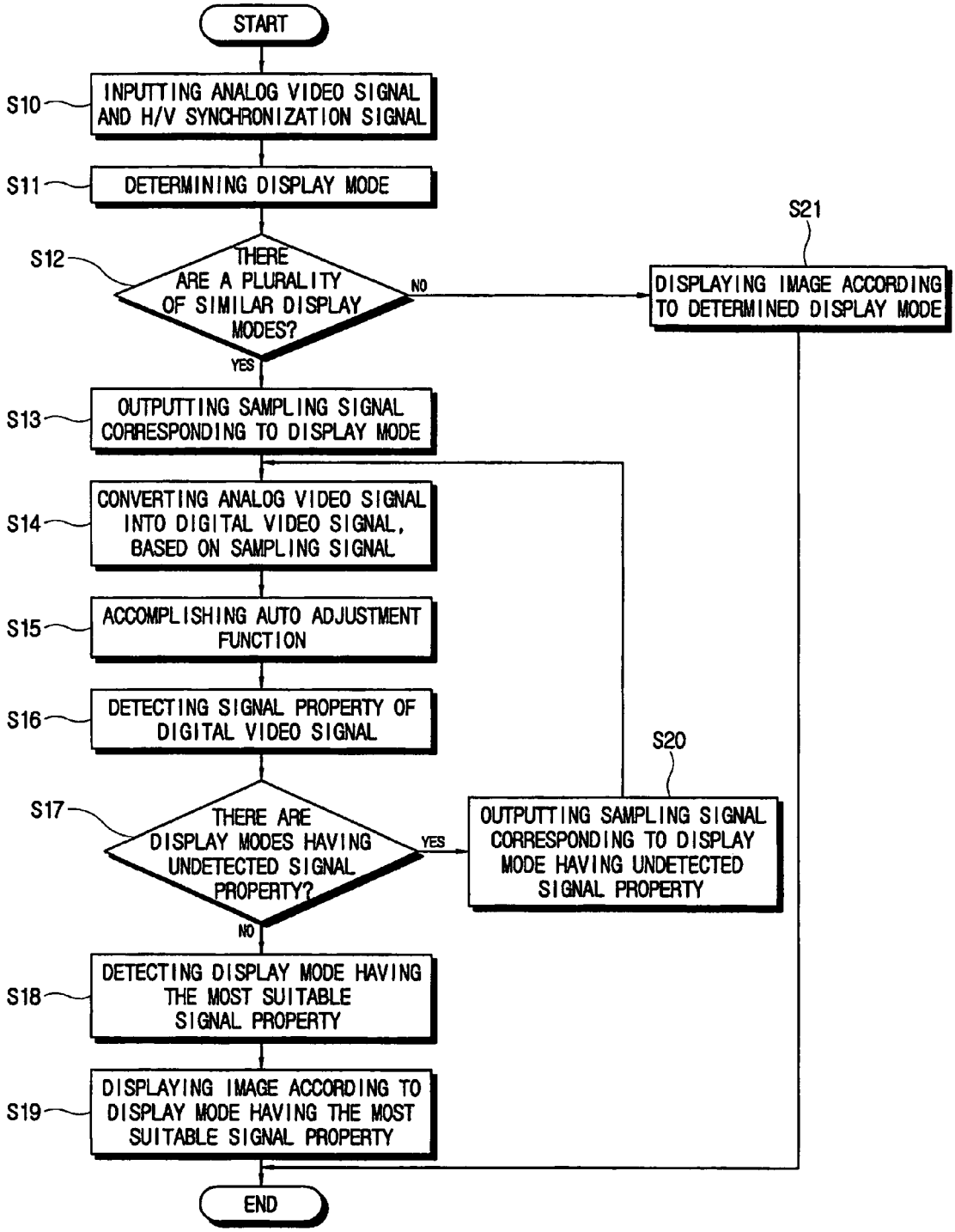
FIG. 2 is a control flow chart of a display according to the embodiment of the invention.

Accordingly, when the controller 14 determines on the basis of the inputted H/V signal that there are a plurality of display modes, the controller 14 controls the signal property detector 18 to detect the signal property of each digital video signal, after an auto adjustment function is performed for each display mode (refer to operation S15 in FIG. 2). Thus, the controller accurately detects the signal property of the digital video signal corresponding to each of the display modes. Here, the auto adjustment function includes auto adjustments of an image position of the inputted video signal and a phase of the sampling signal, and the like, which enables the most suitable image of the corresponding display mode to be displayed.

The invention provides a display to display an image by inputting an analog video signal and an H/V synchronization signal therein, the display including: a sampling signal unit 13 to output a sampling signal to sample the analog video signal; a digital converter 11 to convert the analog video signal into a digital video signal according to the sampling signal; a signal property detector 18 to detect a signal property of the digital video signal; a controller 14 to control the sampling signal unit 13 to output the sampling signal corresponding to each of the display modes, when it is determined there are a plurality of similar display modes, according to the H/V synchronization signal and the signal property detector 18 to detect signal property of each of the digital video signals, according to the sampling signals and to display an image according to the display mode having the signal property that is most suitable, from among signal properties of each of the digital video signals corresponding to each of the sampling signals detected by the signal property detector. Thus, the image according to the display mode that corresponds to the inputted video signal can be displayed.

As described above, the invention provides a display in which the display mode of the inputted video signal is determined accurately and a control method thereof.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A method of determining a display mode from a plurality of display modes for a display device that displays an image, each display mode relates to an inputted signal from a signal source that includes an analog signal and an H/V synchronization signal, the method comprising:

determining at least one display mode corresponding to the inputted H/V synchronization signal, the determined at least one display mode including a plurality of similar display modes, such that each of the similar display modes has a different sampling signal;

converting the inputted analog signal to a digital signal according to a sampling signal corresponding to each of the at least one determined display mode;

calculating a difference between adjacent sampling values of each of the digital signals;

integrating an absolute value of the calculated difference between the adjacent sampling values; and selecting the display mode having the greatest integration value of the absolute value of the difference between the adjacent sampling values; and displaying the image using the selected display mode from the at least one determined display mode that most closely relates to the signal source.

2. The method of determining the display mode as claimed in claim 1, wherein the displaying the image using the display mode that most closely relates to the signal source further comprises:

detecting a property of each converted digital signal; and selecting the display mode having the detected property that most closely relates to the signal source from among the at least one determined display modes.

3. The method of determining the display mode as claimed in claim 2, wherein the detected property is a horizontal and vertical frequency of the H/V synchronization signal.

4. The method of determining the display mode as claimed in claim 1, further comprising sampling the analog signal with a predetermined frequency corresponding to the at least one determined display mode.

5. The method of determining the display mode as claimed in claim 1, further comprising determining the at least one display mode corresponding to the inputted H/V synchronization signal that relates to a resolution and a timing mode of the inputted signal.

6. The method of determining the display mode as claimed in claim 1, further comprising outputting sampling signals for each of the at least one determined display mode, such that each of the sampling signals is different from one another.

7. The method of determining the display mode as claimed in claim 1, wherein each of the similar display modes has a same horizontal and vertical frequency but a different resolution from one another.

8. The method of determining the display mode as claimed in claim 1, wherein each of the similar display modes has a same first determined signal property and a different second determined signal property from one another.

9. The method of determining the display mode as claimed in claim 1, further comprising:

controlling the sampling signal and scaling the converted digital signal to display the image according to a display mode that is most closely related to the inputted signal.

10. A method of determining a display mode from a plurality of display modes for a display device that displays an image, each display mode relates to an inputted signal from a signal source that includes an analog signal and an H/V synchronization signal, the method comprising:

determining at least one display mode corresponding to the inputted H/V synchronization signal, the determined at least one display mode including a plurality of similar display modes, such that each of the similar display modes has a different sampling signal;

converting the inputted analog signal to a digital signal according to a sampling signal corresponding to each of the at least one determined display mode;

temporarily storing frames of each of the converted digital signals, reading out data on at least one same V-line of each of adjacent frames of each of the digital signals from the frame buffer;

detecting a difference between the read data for the adjacent frames of each of the digital signals; and selecting the display mode having a smallest difference relating to the read data, and displaying the image using the selected display mode from the at least one determined display mode that most closely relates to the signal source.

11. A method of determining a display mode from a plurality of display modes for a display device that displays an image, each display mode relates to an inputted signal from a signal source that includes an analog signal and an H/V synchronization signal, the method comprising:

determining at least one display mode corresponding to the inputted H/V synchronization signal, the determined at least one display mode including a plurality of similar display modes, such that each of the similar display modes has a different sampling signal;

converting the inputted analog signal to a digital signal according to a sampling signal corresponding to each of the at least one determined display mode;

determining when a sampling value of each of the digital signals is within a predetermined range;

counting each sampling value of each of the digital signals that is within the predetermined range;

selecting the display mode having a fewest number of counted sampling values; and displaying the image using the selected display mode from the at least one determined display mode that most closely relates to the signal source.

12. A method of determining a display mode from a plurality of display modes for a display device that displays an image, each display mode relates to an inputted signal from a signal source that includes an analog signal and an H/V synchronization signal, the method comprising:

determining at least one display mode corresponding to the inputted H/V synchronization signal, the determined at least one display mode including a plurality of similar display modes, such that each of the similar display modes has a different sampling signal;

converting the inputted analog signal to a digital signal according to a sampling signal corresponding to each of the at least one determined display mode;

determining when a sampling value of each of the digital signals is within a predetermined range;

counting each sampling value of each of the digital signals that is not within the predetermined range;

selecting the display mode having a greatest number of counted sampling values; and displaying the image using the selected display mode from the at least one determined display mode that most closely relates to the signal source.

13. A display device to display an inputted signal relating to one of a plurality of determined similar display modes corresponding to an inputted signal from a signal source, comprising:

a signal property detector to detect a signal property of the inputted signal that is converted according to a sampling signal; and a controller to determine a display mode that most closely relates to the inputted signal from the plurality of determined similar display modes, wherein the controller detects each display mode from among the plurality of similar display modes and outputs a sampling signal corresponding to each of the display modes, respectively, and further controls the signal property detector to detect the signal property of each of the plurality of converted signals, wherein the signal property detector integrates an absolute value of a difference between adjacent sampling values of each of the converted signals corresponding to each of the sampling signals, and the controller controls to display an image according to a display mode having a greatest integration value of an absolute value of a difference between the sampling values.

14. The display device to display the inputted signal relating to one of the plurality of similar display modes as claimed in claim 13, further comprising:

a sampling signal unit to output the sampling signal corresponding to each of the plurality of determined display modes in order to sample the converted inputted signal; and a digital converter to convert the inputted signal to a digital signal according to each of the sampling signals output by the sampling signal unit.

15. A display device to display an inputted signal relating to one of a plurality of determined similar display modes corresponding to an inputted signal from a signal source, comprising:

a signal property detector to detect a signal property of the inputted signal that is converted according to a sampling signal; and a controller to determine a display mode that most closely relates to the inputted signal from the plurality of determined similar display modes, wherein the controller detects each display mode from among the plurality of similar display modes and outputs a sampling signal corresponding to each of the display modes, respectively, and further controls the signal property detector to detect the signal property of each of the plurality of converted signals, wherein the signal property detector counts sampling values within a predetermined range from among sampling values of each of the converted signals corresponding to each of the sampling signals, and the controller controls to display an image according to a display mode having a fewest number of counted sampling values.

16. A display device to display an inputted signal relating to one of a plurality of determined similar display modes corresponding to an inputted signal from a signal source, comprising:

a signal property detector to detect a signal property of the inputted signal that is converted according to a sampling signal; and a controller to determine a display mode that most closely relates to the inputted signal from the plurality of determined similar display modes, wherein the controller detects each display mode from among the plurality of similar display modes and outputs a sampling signal corresponding to each of the display modes, respectively, and further controls the signal property detector to detect the signal property of each of the plurality of converted signals, wherein the signal property detector counts sampling values that are not within a predetermined range from among sampling values of each of the converted signals corresponding to each of the sampling signals, and the controller controlling to display an image according to a display mode having a most number of counted sampling values.

17. The display as claimed in claim 13, wherein the controller controls the signal property detector to detect the signal property of the converted signal according to the sampling signal after an auto adjustment function is performed for each of the similar display modes.

* * * * *